US012264566B2

(12) United States Patent
Schmidt et al.

(10) Patent No.: US 12,264,566 B2
(45) Date of Patent: Apr. 1, 2025

(54) METHOD FOR BOREHOLE COMPLETION

(71) Applicant: Quidnet Energy Inc., Houston, TX (US)

(72) Inventors: Howard K. Schmidt, Hockley, TX (US); Scott Wright, Houston, TX (US)

(73) Assignee: Quidnet Energy, Inc., Houston, TX (US)

( * ) Notice: Subject to any disclaimer, the term of this patent is extended or adjusted under 35 U.S.C. 154(b) by 0 days.

(21) Appl. No.: 18/134,851

(22) Filed: Apr. 14, 2023

(65) Prior Publication Data

US 2024/0076972 A1 Mar. 7, 2024

Related U.S. Application Data

(60) Provisional application No. 63/331,002, filed on Apr. 14, 2022.

(51) Int. Cl.

| | |
|---|---|
| ***E21B 43/26*** | (2006.01) |
| ***E21B 29/00*** | (2006.01) |
| ***E21B 43/10*** | (2006.01) |

(52) U.S. Cl.

CPC ..... *E21B 43/26* (2013.01); *E21B 29/005* (2013.01); *E21B 43/10* (2013.01)

(58) Field of Classification Search

CPC . E21B 43/26; E21B 10/42; E21B 7/00; E21B 10/62; E21B 29/00; E21B 10/32

See application file for complete search history.

(56) References Cited

U.S. PATENT DOCUMENTS 3,211,221 A * 10/1965 Huitt ..... E21B 43/26 166/308.1
3,313,348 A 4/1967 Huitt et al.
2018/0334903 A1* 11/2018 Lehr ..... E21B 49/006

OTHER PUBLICATIONS

English translation of CN 109538183. (Year: 2019).*
"The Impact of Oriented Perforations on FracturePropagation and Complexity in Hydraulic Fracturing" by Liyuan Liu, et. al., published Nov. 1, 2018, which may be found at https://www.mdpi.com/2227-9717/6/11/213/htm.
"Perforation Fundamentals—Basic Knowledge about Perforation Used in Oil and Gas Industry" by DrillingFormulas.com, published Jul. 16, 2016, which may be found at https://www.drillingformulas.com/perforation-fundamentals-basic-knowledge-about-perforation-used-in-oil-and-gas-industry/.

* cited by examiner

*Primary Examiner* — Zakiya W Bates
(74) *Attorney, Agent, or Firm* — Tumey L.L.P.

(57) ABSTRACT

A method for improved borehole completion. In one embodiment, the method comprises removing a section of casing entirely and cutting a notch through the cement and into the surrounding rock formation, wherein the notch optimally comprise a symmetric triangle terminating in a sharp point oriented perpendicular to the casing axis. Flow may be further optimized by extending the notch as far as practical into the rock matrix to increase the effective diameter of the wellbore and increase the length of the intersection between the fracture and the wellbore.

6 Claims, 4 Drawing Sheets

METHOD FOR BOREHOLE COMPLETION

CROSS-REFERENCE TO RELATED APPLICATIONS

This application claims priority to U.S. Provisional Patent Application Ser. No. 63/331,002 filed Apr. 14, 2022, the entire contents of which are incorporated herein by reference thereto.

STATEMENT REGARDING FEDERALLY SPONSORED RESEARCH OR DEVELOPMENT

Not applicable.

BACKGROUND OF THE INVENTION

Field of the Invention

The present invention relates to a method for completing well boreholes; and, more particularly, to a method of completing well boreholes which improves fluid communication between the borehole and the surrounding rock matrix.

Background of the Invention

Fracturing of geologic formations from boreholes is commonly used to allow fluid communication between the borehole and the surrounding rock matrix. Fluid production and injection rates are generally limited by the geometry of the intersection of the borehole and the fracture. Flow resistance is usually attributed to perforations and near wellbore tortuosity. Disclosed herein are methods for improved wellbore completion in preparation for fracturing that eliminates perforation resistance and near wellbore tortuosity while increasing the effective wellbore diameter.

Fracturing is commonly performed in recovery of unconventional oil and gas (UOG) reserves. Hydraulic fracturing and related hydro-shear methods may also be applied in developing geothermal (GT) reservoirs. Recently, fracturing technology has been applied in developing geomechanical pumped storage (GPS) systems. In UOG and GT applications, one may be primarily concerned with maximizing surface area of the fracture, while GPS systems seek to minimize fracture surface area while maximizing efficient fluid flow. In all three, the plane of the fracture is normally perpendicular, or nearly perpendicular, to the axis of the wellbore. Likewise, in all three applications, the wellbore may be cased with a steel pipe to prevent collapse of the wellbore. Similarly, the annular space between the casing and the rock formation may be filled with cement to support the rock while providing zonal isolation and preventing fluid movement behind the casing.

The prevailing method for connecting the wellbore to the rock formation is a set of explosive perforations. Here, shaped charges are detonated at a desired location within the wellbore, creating high velocity jets that penetrate through the casing and cement and some distance into the rock formation. Fluid pressure may be applied which generates and expands a fracture into the rock matrix. Fluid loaded with proppant particles are generally supplied to maintain conductivity in the fracture upon completion of the fracturing job. Typically, the perforations in the steel pipe are usually about 0.4" in diameter, and these represent a significant limiter on fluid flow during production. Further, usually only several of dozens of perforations actually form a fluid connection to the fracture. Further still, the far field fracture plane, dictated by the local stress field, is often not oriented perfectly with one of the perforations. Reorientation of the initial fracture with the far-field fracture through a series of breaks and reorientations results in near wellbore tortuosity that contributes significant resistance to fluid flow. Ultimately fluid flow may be limited by the width of the final fracture. In the situation described, the rock cannot expand freely because the cemented steel casing may be almost entirely intact, effectively pinning the fracture shut near the wellbore.

Consequently, there is a need in the art for an improved method of wellbore completion which reduces, and preferably eliminates, the flow restrictions associated with current wellbore completion methods.

BRIEF SUMMARY OF SOME OF THE PREFERRED EMBODIMENTS

These and other needs in the art are addressed in one embodiment by a method of wellbore completion which comprises removing a section of casing entirely and cutting a notch through the cement and into the surrounding rock formation, said notch optimally comprising a symmetric triangle terminating in a sharp point oriented perpendicular to the casing axis. Flow may be further optimized by extending the notch as far as practical into the rock matrix to increase the effective diameter of the wellbore and increase the length of the intersection between the fracture and the wellbore.

The foregoing has outlined rather broadly the features and technical advantages of the present invention in order that the detailed description of the invention that follows may be better understood. Additional features and advantages of the invention will be described hereinafter that form the subject of the claims of the invention. It should be appreciated by those skilled in the art that the conception and the specific embodiments disclosed may be readily utilized as a basis for modifying or designing other embodiments for carrying out the same purposes of the present invention. It should also be realized by those skilled in the art that such equivalent embodiments do not depart from the spirit and scope of the invention as set forth in the appended claims.

BRIEF DESCRIPTION OF THE DRAWINGS

For a detailed description of the preferred embodiments of the invention, reference will now be made to the accompanying drawings in which.

DETAILED DESCRIPTION OF THE PREFERRED EMBODIMENTS

Figure 1A:
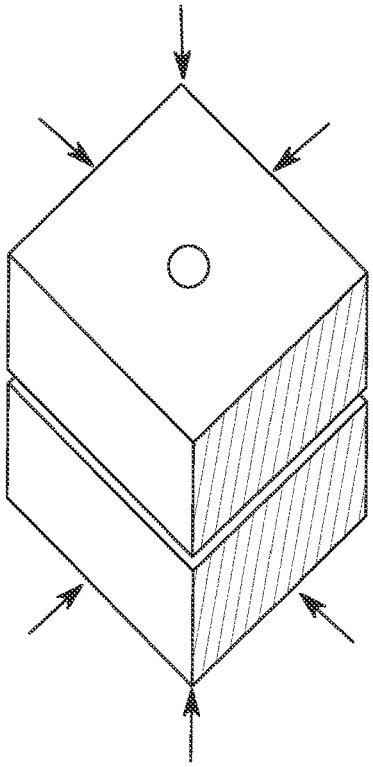
FIGS. 1*a* and 1*b* illustrate typical fractures relative to principal stresses acting upon a formation.
Figure 1B:
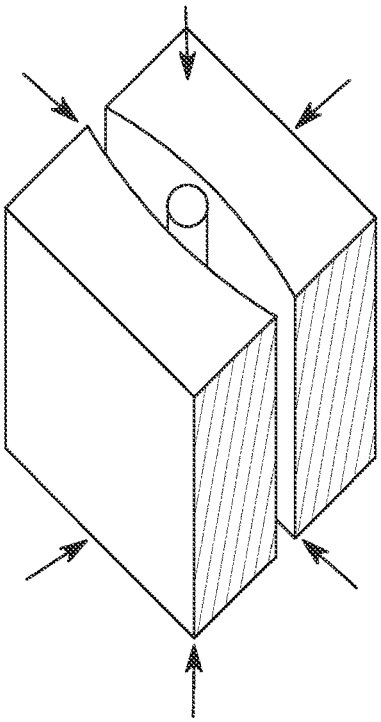

Fractures are generally formed by splitting a rock formation, for example by injecting a fluid into the formation under pressure, where the fluid may comprise hydraulic fluids, water, gasses, other suitable fracturing fluids, or combinations thereof, and may or may not further include proppants. Commonly, such fractures, which may be referred to as hydraulic fractures or gas fractures, may form perpendicular to the smallest principal stress. As illustrated in FIG. 1*a*, generally fractures may be horizontal at shallow depths where the vertical stress may be less than the horizontal stresses, or in regions of substantial tectonic compression. At greater depths (~>2000') or in regions with tectonic tension, fractures may form vertically, or nearly so, as illustrated in FIG. 1*b*. In regions with a nearly uniform stress field, fractures can form preferentially by splitting along bedding planes, if present. An understanding of the interaction between fracture propagation and oriented perforation upon which the methods that follow have been developed is provided by the article "The Impact of Oriented Perforations on Fracture Propagation and Complexity in Hydraulic Fracturing" by Liyuan Liu, et. al., published Nov. 1, 2018, which may be found at https://www.mdpi.com/2227-9717/6/11/213/htm.

Figure 2:
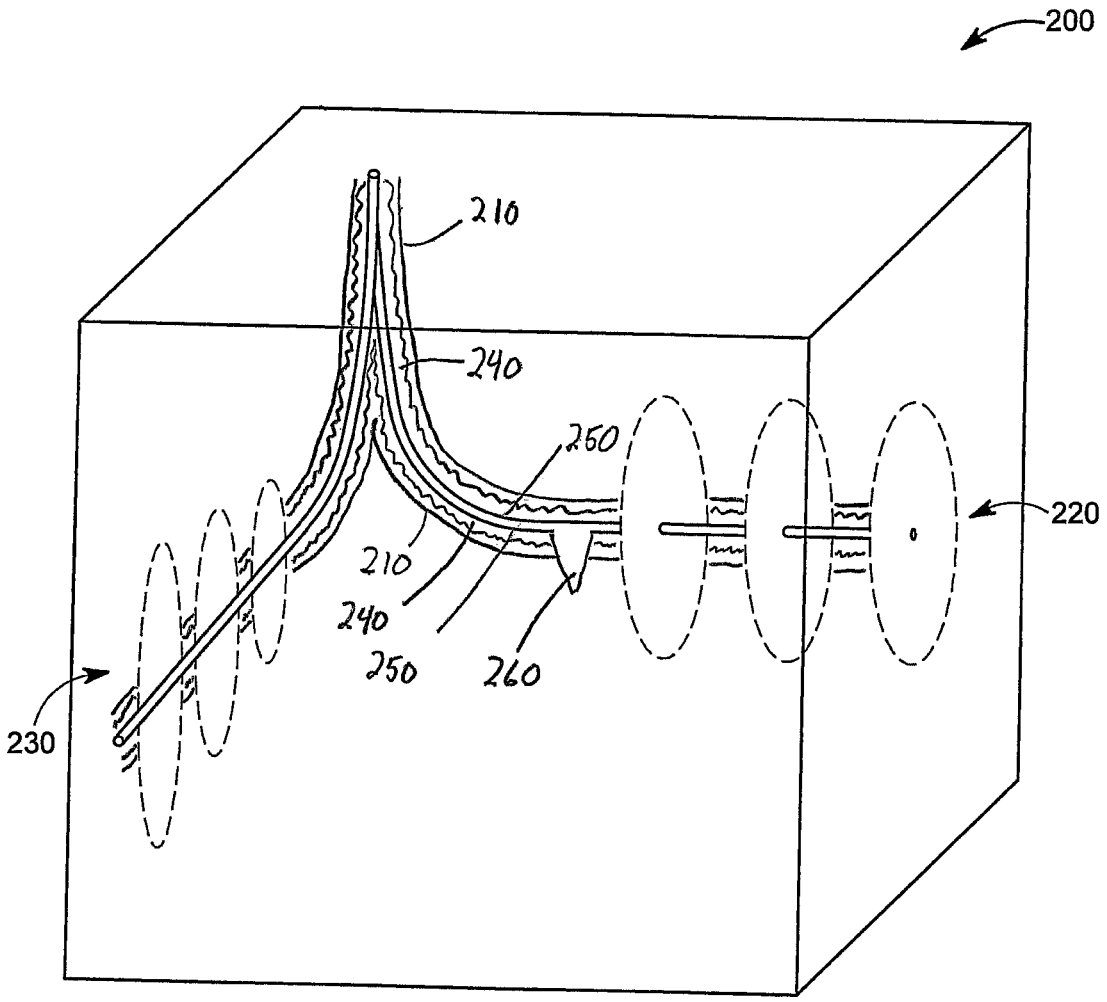
FIG. 2 illustrates two different orientations of a formation fracture relative to a well bore axis.

FIG. 2 illustrates wellbore 210 drilled in two different directions in formation 200. In applications wherein the wellbore axis may not be arranged to lie in the plane of the expected fracture, as illustrated by fracture orientation 220, flow restrictions can be reduced or eliminated through an improved completion which comprises removing a section of wellbore casing 250 entirely, and cutting a notch 260 through the cement 240 and into the surrounding rock formation 200, wherein the notch 260 optimally comprises a symmetric triangle terminating in a sharp point oriented perpendicular to the casing 250 axis. In such applications, flow may be further optimized by extending the notch 260 as far as practical into the rock matrix to increase the effective diameter of the wellbore 210 and increase the length of the intersection between the fracture and the wellbore 210.

Figure 3:
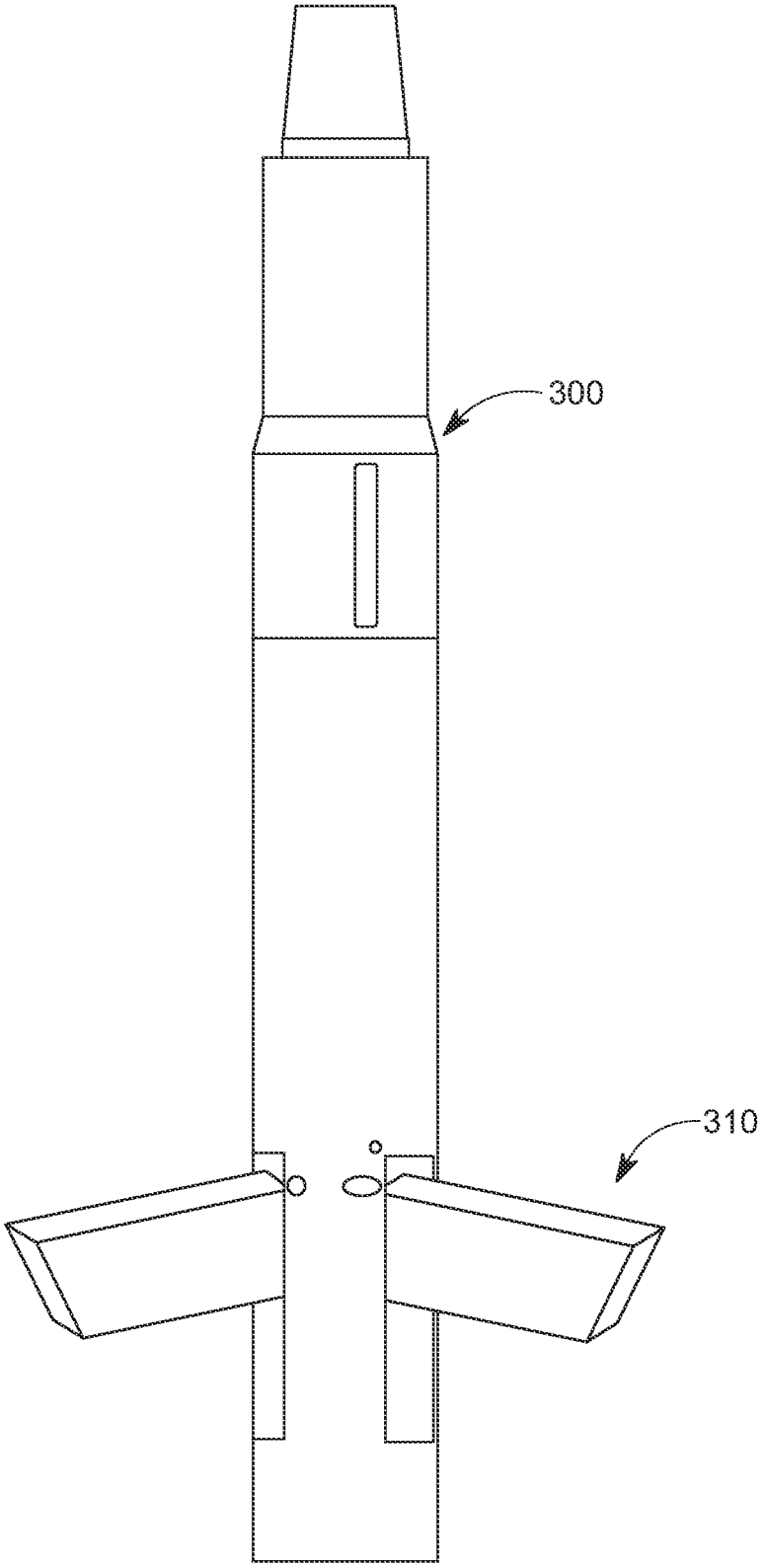
FIG. 3 illustrates an embodiment of a rotary casing cutter.
Figure 4:
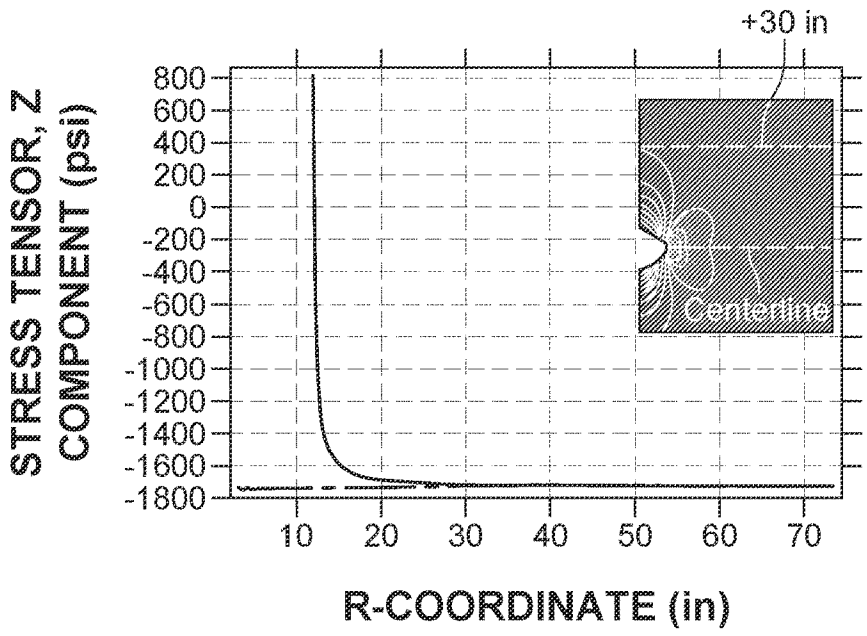
FIG. 4 illustrates an embodiment of a finite element model of fracture initiation stress from milled notches at 90 and 45 degrees.
Figure 4:
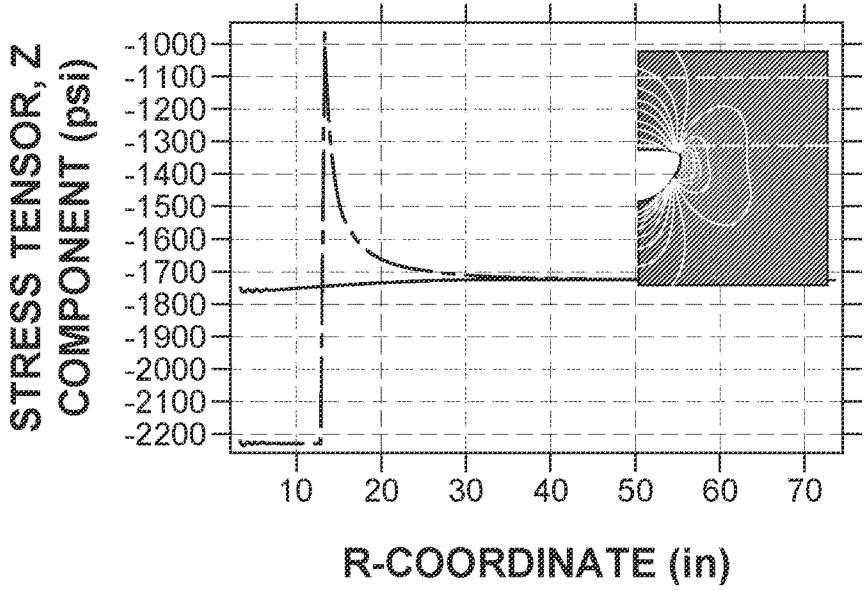

In such applications a preferred tool for the notching operating may comprise a rotary multi-string casing cutter, such as rotary casing cutter 300 illustrated in FIG. 3, having a plurality of cutter arms 310 which have been modified to swing approximately 45 degrees. This modified multi-string casing cutter may be preferable over other cutting tools such as chemical cutters, explosive jet cutters and abrasive jet cutters, which may present limitations or introduce detrimental effects on the surrounding formation. For example, chemical cutters may remove steel casing but leave cement and rock intact. Explosive jet cutters may often fail to sever the pipe, and may additionally generate a complex damage zone in the rock that leads to tortuosity. Abrasive jet cutters may be difficult to control, and their resulting notch geometry may be variable depending on rock inhomogeneities, which may lead to tortuosity. Casing mill/cutters typically are designed having cutter arms which swing approximately 90 degrees, which may tend to initiate fractures at a 45 degree angle to the axis of the wellbore. If the cut is limited to approximately 45 degrees, as with rotary casing cutter 300, the fracture initiation plane may be perpendicular to the wellbore, which may reduce or eliminate re-orientation and tortuosity. As can be seen in the finite element model illustrated by FIG. 4, decreasing the angular section of a milled cut may result in an increase in tensile stress concentration. This method may be desirable in applications where the stress field acting upon the formation may be such that a fracture forms perpendicular to the wellbore, as depicted in FIG. 1*a*. Typically, this method will most commonly be applicable in applications involving a vertical wellbore at fairly shallow depths (less than 2000 ft.) or with a horizontal wellbore at greater depths (greater than 2000 ft.) oriented in parallel to the regions least principle stress direction When the wellbore axis can be arranged to lie in the plane of the expected fracture, as illustrated in FIG. 2 by fracture orientation 230, a modified method may be used to minimize flow resistance. As previously described, it may be desirable that perforation guns are avoided, and a section of casing may be removed via extended milling. Alternatively, the method may be applied to an open hole completion, which may also be obtained by drilling ahead some distance past the casing after cementing the production casing in place. After a desired portion of the formation has been exposed, a fracture may be formed through any technique known in the art, the selection of which may be determined or preferred by a field services provider, which may include, but not be limited to, sand notching, mechanical excavation, explosive jet cutting, chemical cutting, or combinations thereof. For example, a specialized cutting tool may be used to notch the rock formation in the direction of the expected fracture, and in such applications an abrasive jet cutter may be suitable. This procedure allows the fracture to open fully while eliminating perforation and tortuosity resistance. Alternatively, the method of generating fractures parallel to a borehole as illustrated by fracture orientation 230 of FIG. 2 may comprise sand notching or mechanical cutting, each of which may provide an enhanced benefit of retaining mechanical integrity of the casing inside the wellbore by slotting in sections while leaving relatively long sections of the wellbore intact. In typical wellbore completions there are routinely stranded portions of sections at the toe or heel of development programs which result in stranded hydrocarbons. While cross section unitization and extended laterals may address generally 75% of a producible formation, the method of generating fractures parallel to a borehole may increase recoverable hydrocarbon reserves, maximizing the value of land holdings across the spectrum of formation being developed.

Although the present invention and its advantages have been described in detail, it should be understood that various changes, substitutions and alterations may be made herein without departing from the spirit and scope of the invention as defined by the appended claims.

What is claimed is:

1. A method for completing a wellbore in a rock formation, comprising:

providing the wellbore, wherein the wellbore is drilled in two different directions in the rock formation, and further wherein an axis of the wellbore does not lie in the plane of an expected fracture, and further wherein the wellbore comprises a plurality of sections of casing, wherein the plurality of sections of casing are surrounded by cement;

removing a section of casing from the wellbore;

cutting a notch through cement exposed by the removed section of casing and into the surrounding rock formation as far as practical, wherein the notch comprises a symmetric triangle shape terminating in a sharp point oriented perpendicular to an axis of the casing, and wherein the notch is cut with a rotary multi-string casing cutter, wherein the rotary multi-string casing cutter comprises a plurality of cutter arms, wherein each of the plurality of cutter arms has been modified to swing about 45 degrees; and fracturing the rock formation with a fluid.

2. The method of claim 1, wherein the wellbore comprises a vertical wellbore with of depth of less than 2,000 feet.

3. The method of claim 1, wherein the cutting is about 45 degrees to an axis of the wellbore.

4. A method for completing a wellbore in a rock formation, comprising:

drilling a wellbore into a rock formation;

cutting a notch into the surrounding rock formation, wherein the notch comprises a symmetric triangle shape terminating in a sharp point oriented perpendicular to an axis of the wellbore, and wherein the notch is cut with a rotary cutter, wherein the rotary cutter comprises a plurality of cutter arms, wherein each of the plurality of cutter arms has been modified to swing about 45 degrees; and fracturing the rock formation with a fluid.

5. The method of claim 4, further comprising cutting a plurality of notches into the rock formation and creating a plurality of fractures by fracturing the rock formation at each of the plurality of notches, wherein each of the plurality of fractures does not intersect any of the other plurality of fractures.

6. The method of claim 4, wherein the cutting is about 45 degrees to an axis of the wellbore.

* * * * *